US012065787B2

(12) United States Patent
Frazier et al.

(10) Patent No.: US 12,065,787 B2
(45) Date of Patent: Aug. 20, 2024

(54) APPARATUS, SYSTEMS, AND METHODS FOR TURF TRIM STRIP

(71) Applicant: Soccer Park, LLC, Boise, ID (US)

(72) Inventors: Joshua Leland Frazier, Boise, ID (US); Justin Shook, Boise, ID (US)

(73) Assignee: Soccer Park, LLC, Boise, ID (US)

( * ) Notice: Subject to any disclaimer, the term of this patent is extended or adjusted under 35 U.S.C. 154(b) by 28 days.

(21) Appl. No.: 17/938,407

(22) Filed: Oct. 6, 2022

(65) Prior Publication Data

US 2024/0117574 A1 Apr. 11, 2024

(51) Int. Cl.
*A47G 27/04* (2006.01)
*E01C 13/08* (2006.01)

(52) U.S. Cl.
CPC ..... *E01C 13/08* (2013.01)

(58) Field of Classification Search
CPC .... A47G 27/00; A47G 27/04; A47G 27/0406; A47G 27/0418; A47G 27/0462; A47G 27/0437; A47G 27/045; E01C 13/08; E01C 16/16; E01C 16/04; E01C 16/05; E01C 16/07–10
See application file for complete search history.

(56) References Cited

U.S. PATENT DOCUMENTS 1,052,617 A * 2/1913 Norman ..... A47G 27/0268 15/215
1,724,288 A * 8/1929 La Brecque ..... A47G 27/0456 411/461
1,836,375 A * 12/1931 Kernochan ..... A47G 27/06 16/10
1,847,373 A * 3/1932 Awbrey ..... A47G 27/0462 16/7
2,611,918 A * 9/1952 Jaasund ..... A47G 27/045 16/5
2,709,826 A * 6/1955 Reinhard ..... A47G 27/0462 16/10
2,750,621 A * 6/1956 White ..... A47G 27/06 16/10

(Continued)

FOREIGN PATENT DOCUMENTS

CN 208184157 U * 12/2018
EP 1310198 A2 * 5/2003 ..... A47G 27/0456

(Continued)

*Primary Examiner* — Chuck Y Mah
(74) *Attorney, Agent, or Firm* — Parsons Behle & Latimer

(57) ABSTRACT

Apparatuses, systems, and methods for a turf trim strip. The apparatus includes a first panel having first top and bottom surfaces, first and second edges, and first and second ends and a second panel having a second top and bottom surfaces, third and fourth edges, and third and fourth ends. The second top surface is oriented substantially perpendicular to the first top surface and the second edge is adjacent to the third edge. The apparatus includes a plurality of turf tabs that have a first position substantially parallel to the first top surface and a second position that is at an acute angle with respect to the first top surface. In the second position, the plurality of turf tabs extends towards the second top surface and may secure turf to the strip. A plurality of wall tabs may be used with fasteners to connect the apparatus to a wall.

20 Claims, 6 Drawing Sheets

(56) References Cited

U.S. PATENT DOCUMENTS

| | | | | | |
|---|---|---|---|---|---|
| 3,950,816 | A * | 4/1976 | Hill | A47G 27/0462 | 16/16 |
| 4,069,542 | A * | 1/1978 | Carder | A47G 27/0462 | 24/304 |
| 4,682,925 | A * | 7/1987 | Shields | A47C 21/022 | 411/461 |
| 5,661,874 | A * | 9/1997 | Latour | A47G 27/0462 | 16/16 |
| 5,848,548 | A * | 12/1998 | Latour | A47G 27/0462 | 29/415 |
| 6,038,733 | A * | 3/2000 | Carder | A47G 27/0462 | 16/16 |
| 7,392,626 | B2 * | 7/2008 | Farrend | A47G 27/0462 | 52/273 |
| 9,464,433 | B1 * | 10/2016 | Hulka | F16B 15/003 | |
| 2001/0045253 | A1 * | 11/2001 | Billson | A47G 27/0462 | 156/92 |
| 2007/0256274 | A1 * | 11/2007 | Taylor | A47G 27/0462 | 52/698 |
| 2008/0313850 | A1 * | 12/2008 | Pongrac | A47G 27/0462 | 16/16 |
| 2014/0047671 | A1 * | 2/2014 | Greathouse | F16B 5/12 | 156/60 |
| 2018/0371706 | A1 * | 12/2018 | Ziegan | A01G 9/28 | |

FOREIGN PATENT DOCUMENTS

| | | | | |
|---|---|---|---|---|
| GB | 2217197 A | * | 10/1989 | A47G 27/0462 |
| GB | 2334439 A | * | 8/1999 | A47G 27/0462 |

* cited by examiner

APPARATUS, SYSTEMS, AND METHODS FOR TURF TRIM STRIP

Field of the Disclosure

The embodiments described herein relate to apparatuses, systems, and methods for a turf trim strip that may be used to secure turf. The turf may be used on various fields, which may be, but is not limited to, a soccer field.

BACKGROUND

Description of the Related Art

It may be important to have local sporting fields to permit individuals to exercise, engage in sporting contests, and/or engage in various outdoor activities. Sporting fields may use turf instead of grass. The turf is stretched to the edges of the fields, but over time may develop wrinkles and/or may move away from the perimeter of the field. Other disadvantages may exist.

SUMMARY

The present disclosure is directed to apparatuses, systems, and methods for a turf trim strip that overcomes at least one of the disadvantages discussed above. The turf trim strip may be used with, but is not limited to, a soccer field. The tuft trim strip may be connectable to walls of a modular field.

One embodiment of the disclosure is an apparatus having a first panel and a second panel. The first panel having a first top surface, a first bottom surface, a first edge, a second edge, a first end, and a second end. The second panel having a second top surface, a second bottom surface, a third edge, a fourth edge, a third end, and a fourth end. The second top surface of the second panel is oriented substantially perpendicular to the first top surface of the first panel and the second edge of the first panel is adjacent to the third edge of the second panel. The apparatus includes a plurality of turf tabs along the first panel, the plurality of turf tabs being positioned between the first and second edges and between the first and second ends of the first panel. The plurality of turf tabs having a first position substantially parallel to the first top surface of the first panel and a second position that is at an acute angle with respect to the first top surface of the first panel. In the second position, the plurality of turf tabs extends away from the first top surface of the first panel and toward the second panel. The acute angle may be between approximately 10 degrees and 60 degrees. The acute angle may be between 30 degrees and 45 degrees.

The first and second edges of the apparatus may have a first length and the first and second ends may have a second length with the second length being less than the first length. The third and fourth edges of the apparatus may have the first length and the third and fourth ends of the apparatus may have a third length with the third length being less than the second length. The second edge of the first panel may be connected to the third edge of the second panel. The apparatus may include a bend, the bend forming the second edge of the first panel and the third edge of the second panel.

Each turf tab of the plurality of turf tabs of the apparatus may include a plurality of teeth. The apparatus may include a plurality of wall tabs, each wall tab of the plurality of wall tabs includes a slot. The slot of each wall tab of the plurality of wall tabs may be formed in both the first panel and the second panel. The plurality of wall tabs may have an initial position and a bent position. In the initial position, a first portion of each wall tab of the plurality of wall tabs may be substantially parallel to the second panel and a second portion of each wall tab of the plurality of wall tabs may be substantially parallel to the first panel. In the bent position, the second portion of each wall tab may be substantially perpendicular to the first bottom surface of the first panel and may extend away from the first bottom surface of the first panel. Each turf tab of the plurality of turf tabs may include two elongated openings formed in the first panel.

One embodiment of the present disclosure is a system having a first panel, a second panel, a portion of turf, and a plurality of turf tabs. The first panel includes a first top surface, a first bottom surface, a first edge, a second edge, a first end, and a second end. The second panel includes a second top surface, a second bottom surface, third edge, a fourth edge, a third end, and a fourth end, wherein the second top surface of the second panel is oriented perpendicular to the first top surface of the first panel and the second edge of the first panel is adjacent to the third edge of the second panel. The plurality of turf tabs are along the first panel. The plurality of turf tabs are positioned between the first and second edges and between the first and second ends of the first panel. The plurality of turf tabs have a first position substantially parallel to the first top surface of the first panel and a second position that is at an acute angle with respect to the first top surface of the first panel. The plurality of turf tabs extend away from the first top surface of the first panel in the second position and secure the portion of turf to the first panel.

The system may include a portion of a pad layer. The first panel may be positioned between the portion of the pad layer and the portion of the turf. The system may include a first plurality of fasteners that secure the portion of the turf to the first panel. The first panel and the second panel may be a unitary member. The system may include a plurality of wall tabs positioned between the first and second ends of the first panel and between the third and fourth ends of the second panel. Each wall tab may include a slot. The slot of each wall tab may be formed in both the first panel and the second panel. The system may include a wall portion. The wall portion may be connected to the second panel via a second plurality of fasteners. Each fastener of the second plurality of fasteners may be positioned through a respective one of the slots of the plurality of wall tabs. Each turf tab may include a plurality of teeth.

One embodiment of the disclosure is a method. The method comprises cutting a plurality of turf tabs into a member. The method includes cutting a plurality of wall tabs into the member. The method includes cutting a slot in each wall tab of the plurality of wall tabs. The method includes bending the member to form a first panel and a second panel.

The first panel includes a first top surface, a first bottom surface, a first edge, a second edge, a first end, and a second end. The second panel includes a second top surface, a second bottom surface, third edge, a fourth edge, a third end, and a fourth end. The second top surface of the second panel is oriented perpendicular to the first top surface of the first panel and the second edge of the first panel is adjacent to the third edge of the second panel. The plurality of turf tabs have a first position substantially parallel to the first top surface of the first panel and a second position that is at an acute angle with respect to the first top surface of the first panel. A first portion of each slot is in the first panel and a second portion of each slot is in the second panel. The plurality of wall tabs have an initial position and a bent position. In the initial position, a first portion of each wall tab of the plurality of wall tabs is substantially parallel to the second panel and a second portion of each wall tab of the plurality of wall tabs is substantially parallel to the first panel. In the bent position, the second portion of each wall tab is substantially perpendicular to the first bottom surface of the first panel and extends away from the first bottom surface of the first panel.

The method may include cutting teeth and two adjacent elongated openings for each turf tab of the plurality of turf tabs. The method may include using a laser cutter to cut the plurality of turf tabs, cut the plurality of wall tabs, and cut the slot in each of the wall tabs.

Figure 1:
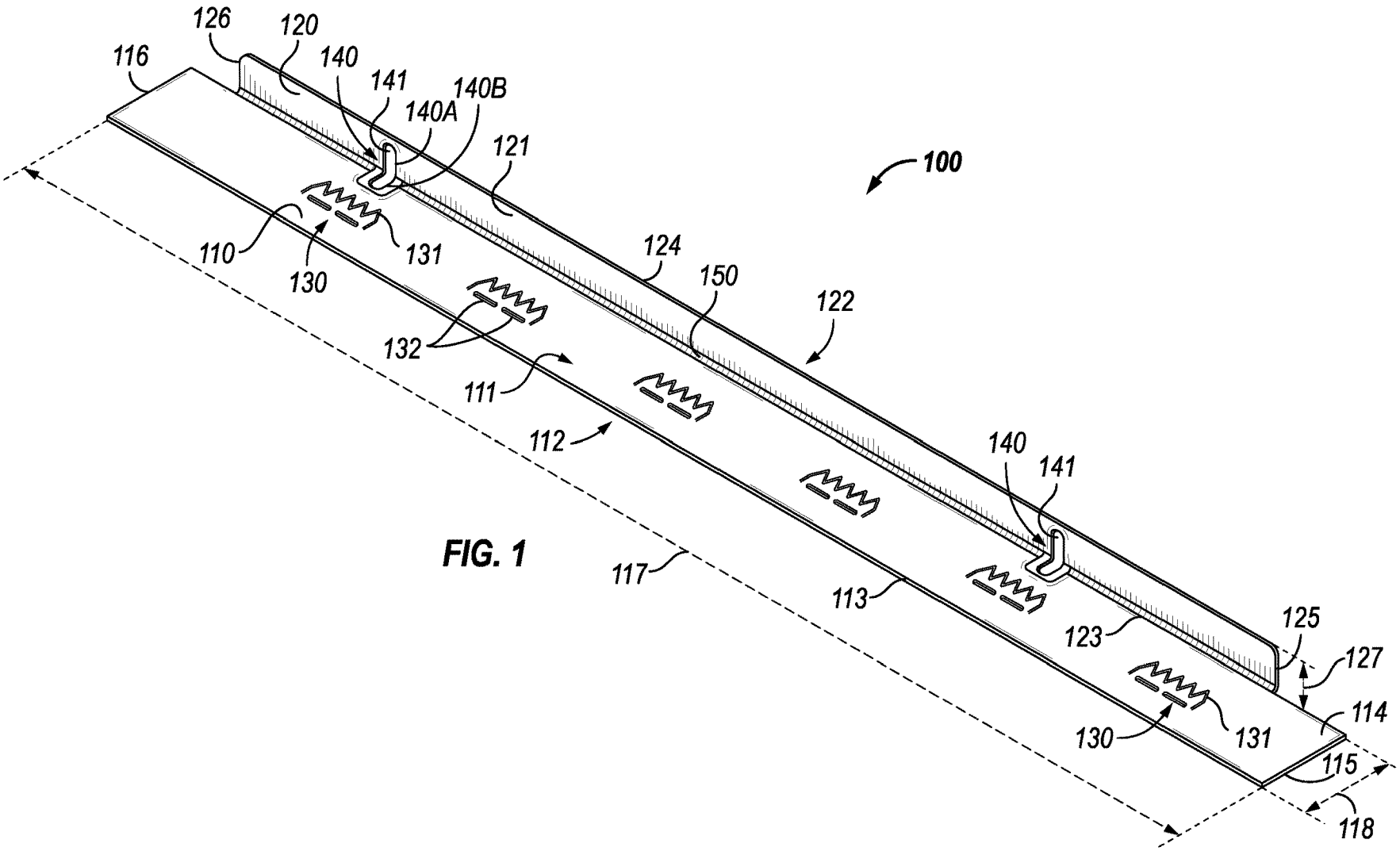
FIG. 1 shows a perspective view of an embodiment of an apparatus of the disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a perspective view of an embodiment of an apparatus 100, also referred to herein as a turf trim strip. The apparatus 100 includes a first panel 110 and a second panel 120. The first panel 110 has a first top surface 111, a first bottom surface 112, a first edge 113, a second edge 114, a first end 115, and a second end 116. The second panel 120 includes a second top surface 121, a second bottom surface 122, a third edge 123, a fourth edge 124, a third end 125, and a fourth end 126.

The second top surface 121 of the second panel 120 is oriented substantially perpendicular to the first top surface 111 of the first panel 110. The second edge 114 of the first panel 110 is adjacent to the third edge 123 of the second panel 120. The second edge 114 of the first panel 110 and the third edge 123 of the second panel 120 may be formed by a bend 150 between the panels 110, 120. In other words, the first and second panels 110, 120 may be comprised of a unitary member and may be formed by bending the unitary member to form the first and second panels 110, 120 as well as the second edge 114 and the third edge 123. Alternatively, the first and second panels 110, 120 may be separate members that are connected together along the second edge 114 and the third edge 123 as would be appreciated by one of ordinary skill in the art having the benefit of this disclosure.

The apparatus 100 includes a plurality of turf tabs 130 along the first panel 110. The plurality of turf tabs 130 are positioned between the first and second edges 113, 114 and between the first and second ends 115, 116 of the first panel 110. The plurality of turf tabs 130 having a first position substantially parallel to the first top surface 111 of the first panel 110 as shown in FIG. 1. The plurality of turf tabs 130 have a second position (shown in FIGS. 2-5) that is at an acute angle 133 (best shown in FIG. 5) with respect to the first top surface 111 of the first panel 110. In the second position, the plurality of turf tabs 130 extends away from the first top surface 111 of the first panel 110. The turf tabs 130 in the second position may be used to secure turf used in a playing field. Turf may be stretched from wall to wall on a field. Over time, the turf may tend to contract and move away from the exterior walls. The turf tabs 130 of the apparatus 100 may be used to secure the turf when in the second position.

The first and second edges 113, 114 of the apparatus 100 have a first length 117 and the first and second ends 115, 116 have a second length 118. The second length 118 is less than the first length 117. The third and fourth edges 123, 124 of the apparatus 100 may also have the first length 117 or may a length less than the first length 117. The third and fourth ends 125, 126 of the apparatus 100 have a third length 127 with the third length 127 being less than the second length 118.

Each turf tab 130 includes a plurality of teeth 131. The teeth 131 may be used to secure a portion of turf. The configuration of the teeth 131 are shown for illustrative purposes and may be varied as would be appreciated by one of ordinary skill in the art having the benefit of this disclosure. For example, the number, shape, configuration and/or location of the teeth 131 may be varied. Other shapes may be used in connected with the turf tab 130 to secure turf to the apparatus 100. The turf tabs 130 in the first panel 110 may include two elongated openings 132 through the first panel 110 adjacent to the teeth 131. The elongated openings 132 are configured to aid in bending the turf tabs 130 from the first position (shown in FIG. 1) to the second position (shown in FIG. 2). The size, shape, number, and/or configuration of the elongated openings 132 may be varied as would be appreciated by one of ordinary skill in the art having the benefit of this disclosure.

The apparatus 100 includes a plurality of wall tabs 140. Each wall tab 140 includes a slot 141. The slot 141 of each wall tab 140 is formed in both the first panel 110 and the second panel 120. The wall tabs 140 have an initial position (shown in FIG. 1) and a bent position (shown in FIG. 5). In the initial position, a first portion 140A of each wall tab 140 is substantially parallel to the second panel 120 and a second portion 140B of each wall tab 140 is substantially parallel to the first panel 110. In the bent position (shown in FIG. 5), the second portion 140B of each wall tab 140 is substantially perpendicular to the first bottom surface 112 of the first panel 110 and may extend away from the first bottom surface 112 of the first panel 110. A fastener may be inserted into the slot 141 of the wall tab 140 to secure the apparatus 100 to a wall as discussed herein. The wall tab 140 in the bent position enables a fastener to be inserted into the slot 141 below the first panel 110 if needed due to the thickness of a pad layer as discussed herein.

Figure 2:
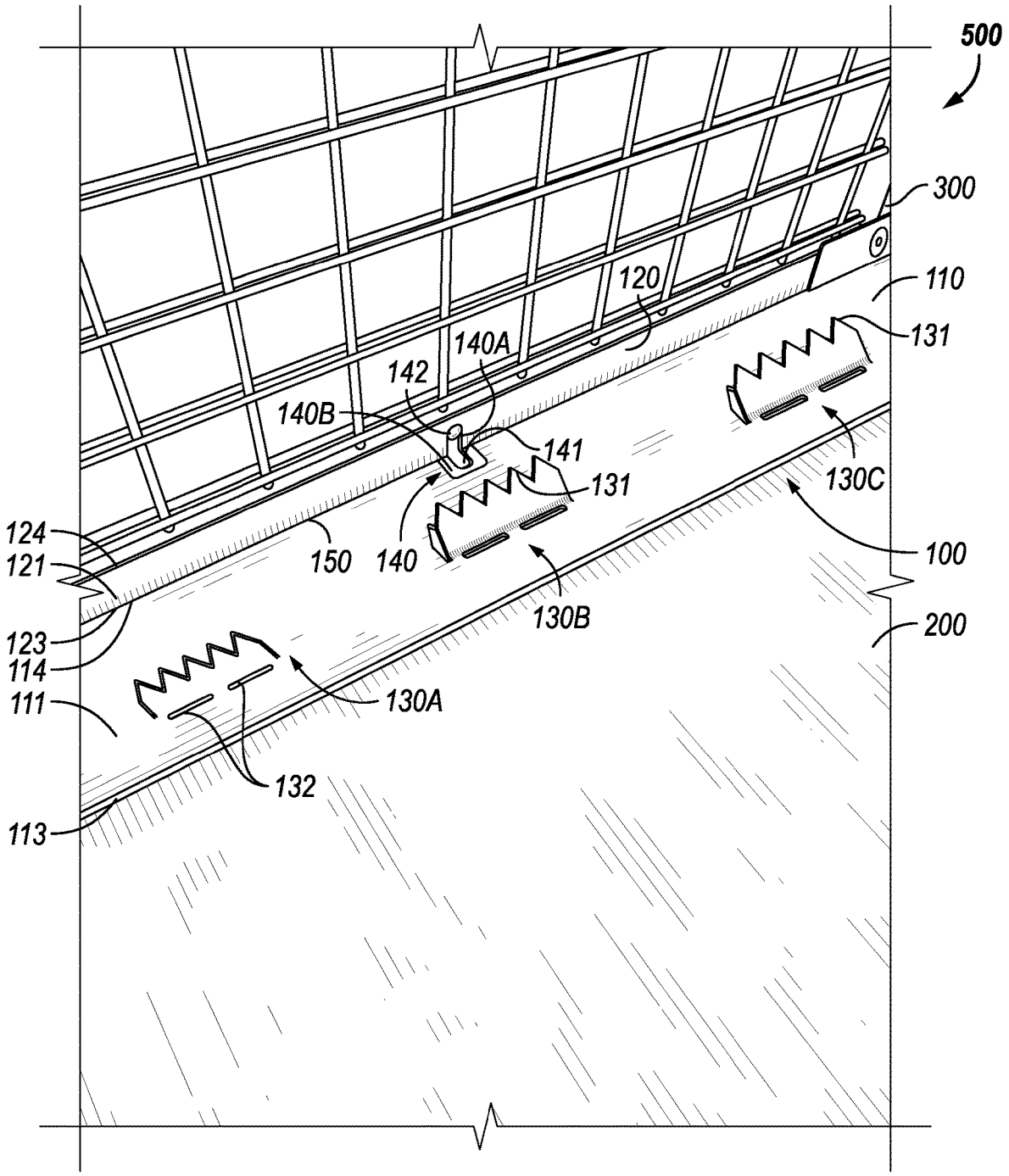
FIG. 2 is a schematic of an embodiment of a system of the disclosure.
Figure 3:
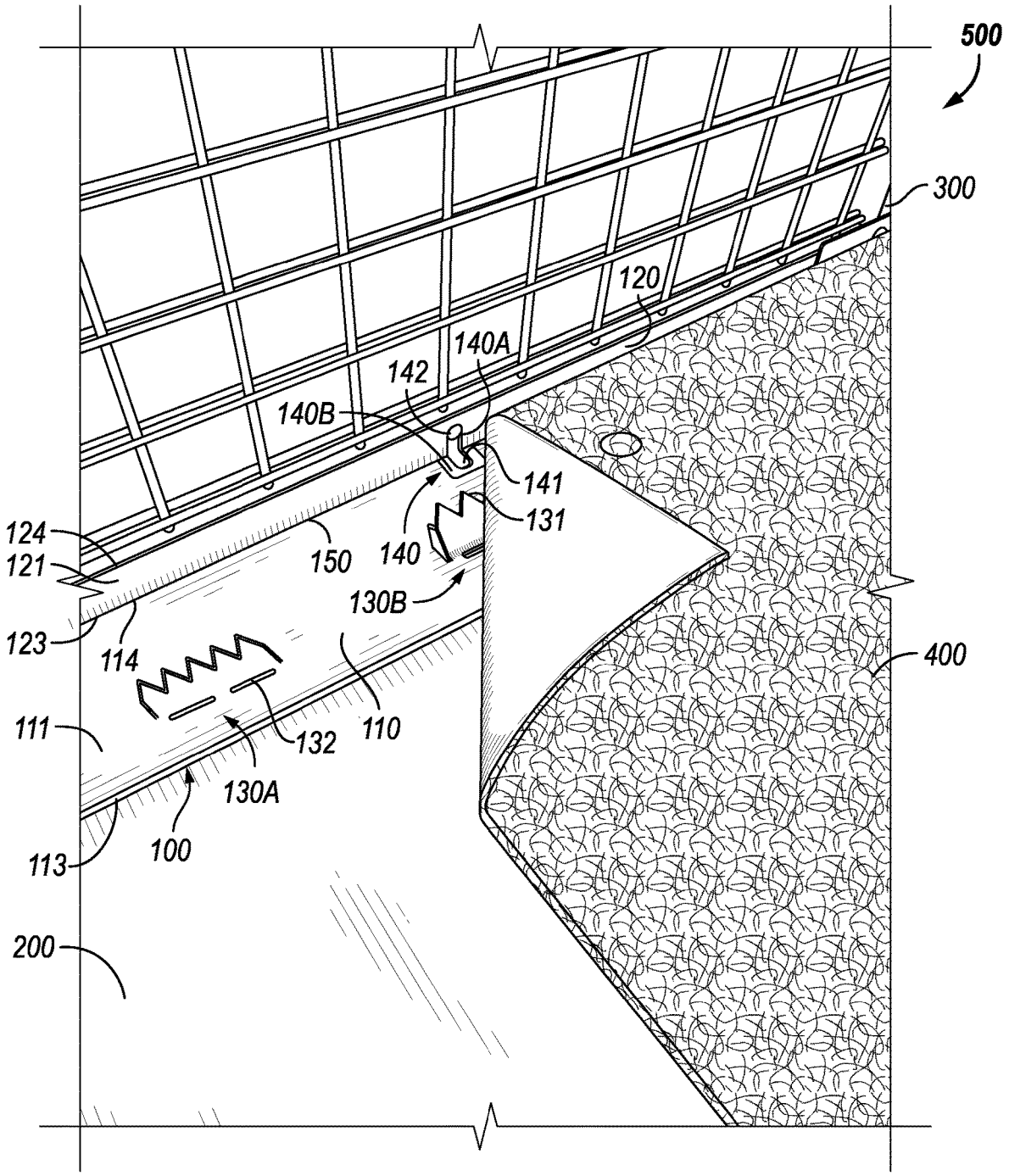
FIG. 3 is a schematic of an embodiment of a system of the disclosure.
Figure 4:
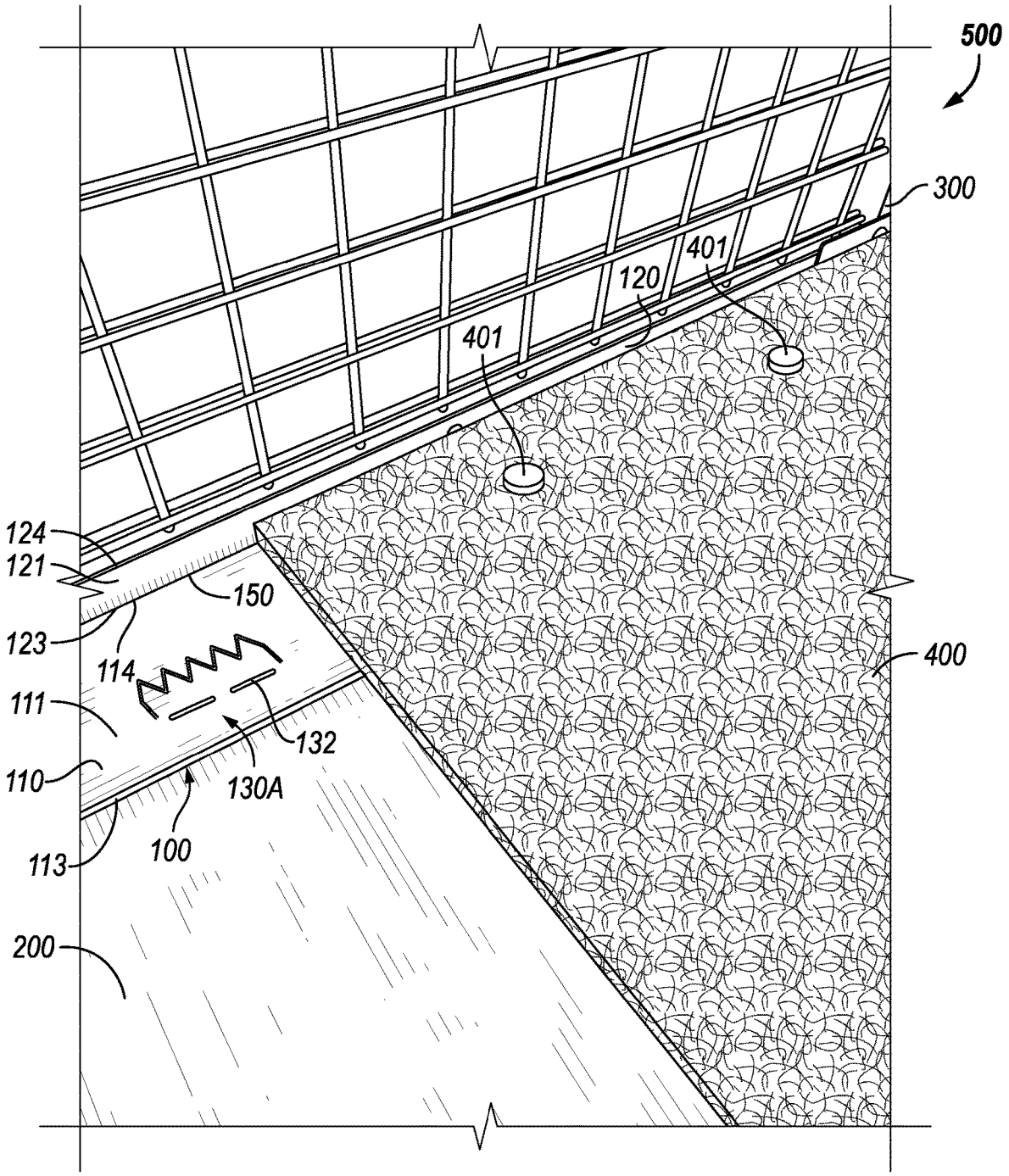
FIG. 4 is a schematic of an embodiment of a system of the disclosure.

FIGS. 2-4 show an embodiment of a system 500 of the present disclosure. The system includes a turf trim strip 100 that includes first panel 110, a second panel 120, and a plurality of turf tabs 130A, 130B, and 130C (collectively 130). The turf trim strip 100 also includes a one or more wall tabs 140. The system 500 includes at least a portion of turf 400 (shown in FIGS. 3 and 4), at least a portion of a pad layer 200, and one or more walls 300.

The first panel 110 of the turf trim strip 100 includes a first top surface 111, a first bottom surface 112 (shown in FIG. 1), a first edge 113, a second edge 114, a first end 115 (shown in FIG. 1), and a second end 116 (shown in FIG. 1). The second panel 120 includes a second top surface 121, a second bottom surface 122 (shown in FIG. 1), third edge 123, a fourth edge 124, a third end 125 (shown in FIG. 1), and a fourth end 126 (shown in FIG. 1). The second top surface 121 of the second panel 122 is oriented substantially perpendicular to the first top surface 111 of the first panel 110. The second edge 114 of the first panel 110 is adjacent to the third edge 123 of the second panel 120. As discussed herein, the first and second panels 110, 120 may be formed by bending a unitary member to create the first and second panels 110, 120.

The turf trim strip 100 includes a plurality of turf tabs 130 along the first panel 110. The plurality of turf tabs 130 are positioned between the first and second edges 113, 114 and between the first and second ends 115, 116 of the first panel 110. The plurality of turf tabs 130 have a first position substantially parallel to the first top surface 111 of the first panel 110 and a second position that is at an acute angle 133 with respect to the first top surface 111 of the first panel 110. As used herein, the acute angle 133 is an angle that is less than 90 degrees and more than 0 degrees measured between the first top surface 111 of the first panel 110 and the bottom surface of the turf tab 130. In one embodiment, the acute angle 133 is between 30 and 45 degrees. In another embodiment, the acute angle 133 is between approximately 10 and approximately 60 degrees. The plurality of turf tabs 130 extend away from the first top surface 111 of the first panel 110 and toward the second panel 120 in the second position and may be used to secure the portion of turf 400 to the first panel 110. The turf tabs 130 om the second position may prevent the turf 400 from pulling or moving away from the wall 300. Turf tab 130A is shown in the first position and turf tabs 130B, 130C are shown in the second position. The teeth 131 of turf tabs 130B, 130C are extended away from the first panel 110 and may be used to secure the turf 400.

The system 500 include a portion of a pad layer 200. The pad layer 200 is used to provide cushion to the playing field as would be appreciated by one of ordinary skill in the art having the benefit of this disclosure. The first panel 110 of the turf trim strip 100 is positioned between the portion of the pad layer 200 and the portion of the turf 400. The system 500 includes a first plurality of fasteners 401 (shown in FIG. 4) that secure the portion of the turf 400 to the first panel 110 of the turf trim strip 100. As discussed herein, the turf tabs 130 may be used to prevent the turf 400 from contracting away from the wall 300, which is connected to the turf trim strip 100 as discussed herein. In addition, the plurality of fasteners 401 may be used to also secure the turf 400 to the turf trim strip 100. The fasteners may be screwed down through the turf 400 and into the first panel 110, which may be made of aluminum or the like. The plurality of fasteners 401 are shown for illustrative purposes and may be varied as would be appreciated by one of ordinary skill in the art. For example, the size, shape, location, number, and/or configuration may be varied.

The turf trim strip 100 includes a plurality of wall tabs 140 positioned between the first and second ends 115, 116 of the first panel 110 and between the third and fourth ends 125,126 of the second panel 120. Each wall tab 140 includes a slot 141. The slot 141 of each wall tab 140 is formed in both the first panel 110 and the second panel 120. A wall 300 of the system 500 is connected to the second panel 120 of the turf trim strip via a second plurality of fasteners 142. Each fastener 142 of the second plurality of fasteners 142 is positioned through a respective one of the slots 141 of the plurality of wall tabs 140.

Figure 5:
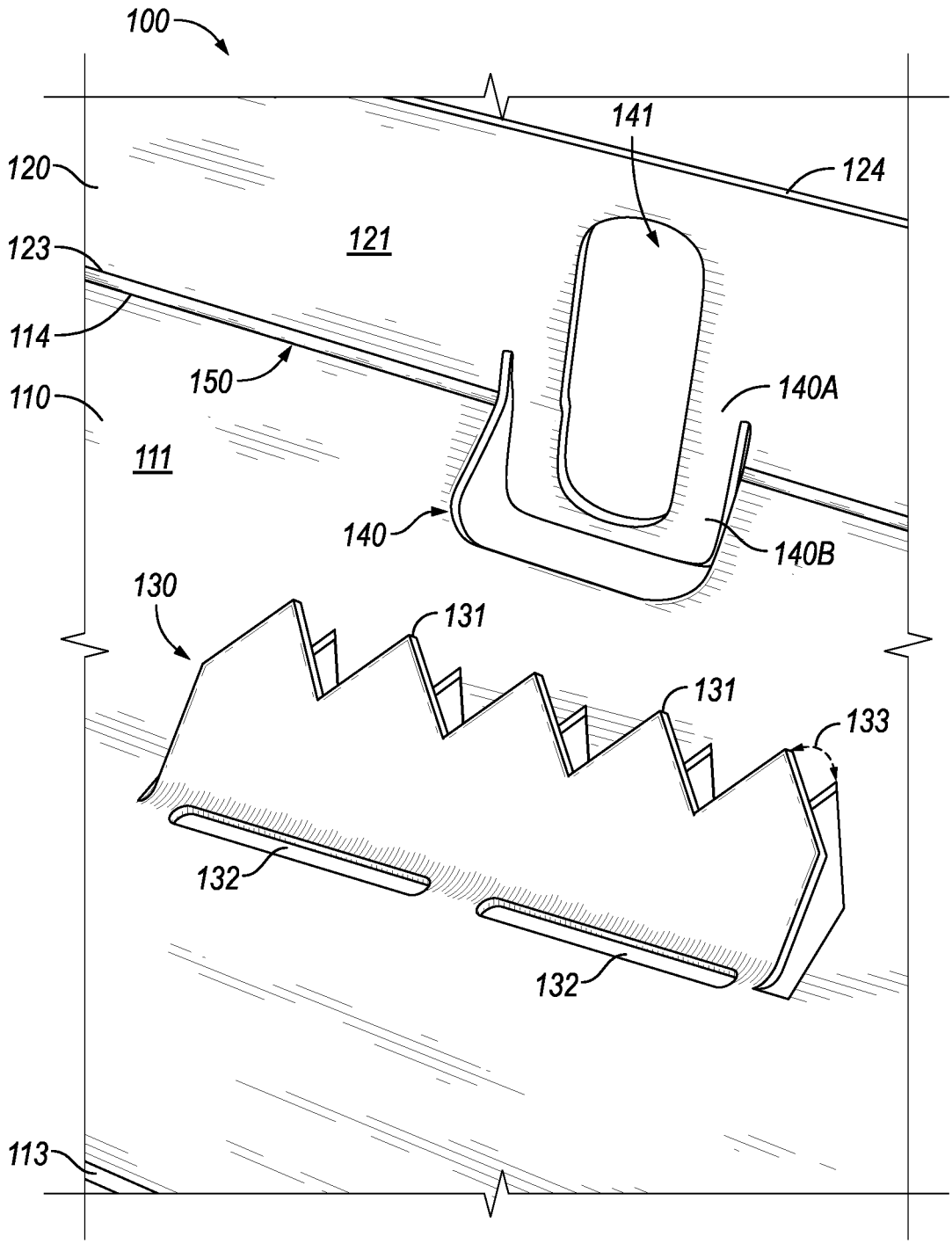
FIG. 5 is a close-up partial view of an embodiment of an apparatus of the disclosure.

As the thickness of the padding layer 200 may vary depending on the application, it may be necessary to connect the wall 300 to the turf trim strip 100 below the first panel 110 rather than above the first panel 110. The wall tabs 140 are configured to have an initial position (shown in FIG. 2) and a bent position (shown in FIG. 5). FIG. 2 shows a fastener 142 inserted through the slot 141 of the wall tab 140 above the first panel 110 of the turf trim strip 100. In this instance, the wall tab 140 remains in the initial position. However, it may be necessary to bend the wall tab 140 to the bent position so that a fastener 142 may be inserted through the slot 141 below the first panel 110 as shown in FIG. 5. The elongated slot 141 enables the turf trim strip 100 to be used to connect to a wall 300 of a playing field having various thickness of padding layer 200.

FIG. 4 shows a portion of turf 400 being positioned against the wall 300 and turf trim strip 100 of a system 500. The turf tab 130 has been bent to the second position to secure the turf 400 in place adjacent to the wall 300. FIG. 5 shows a portion of turf 400 in place on the turf trim strip 100 against the wall 300. In addition to the turf tabs 130, a second plurality of fasteners 401 secure the turf 400 to the turf trim strip 100, which is connected to the wall 300 via fasteners 142 through slots 141 in the wall tabs 140.

FIG. 5 shows a closeup view of a portion of the turf trim strip 100. FIG. 5 shows a turf tab 130 in the second position with the teeth 131 extending away from the first top surface 111 of the first panel 110. FIG. 5 also shows a wall tab 140 in the bent position. The second portion 140B of the wall tab 140 has been bent downward so that the second portion 140B of the wall tab 140 is substantially parallel with the second panel 120 and extends away from the first bottom surface 112 of the first panel 110. In this configuration, the slot 141 extends both above and below the first panel 110 and enables a fastener (not shown in FIG. 5) to be inserted into the slot 141 at various heights include below the first panel 110.

Figure 6:
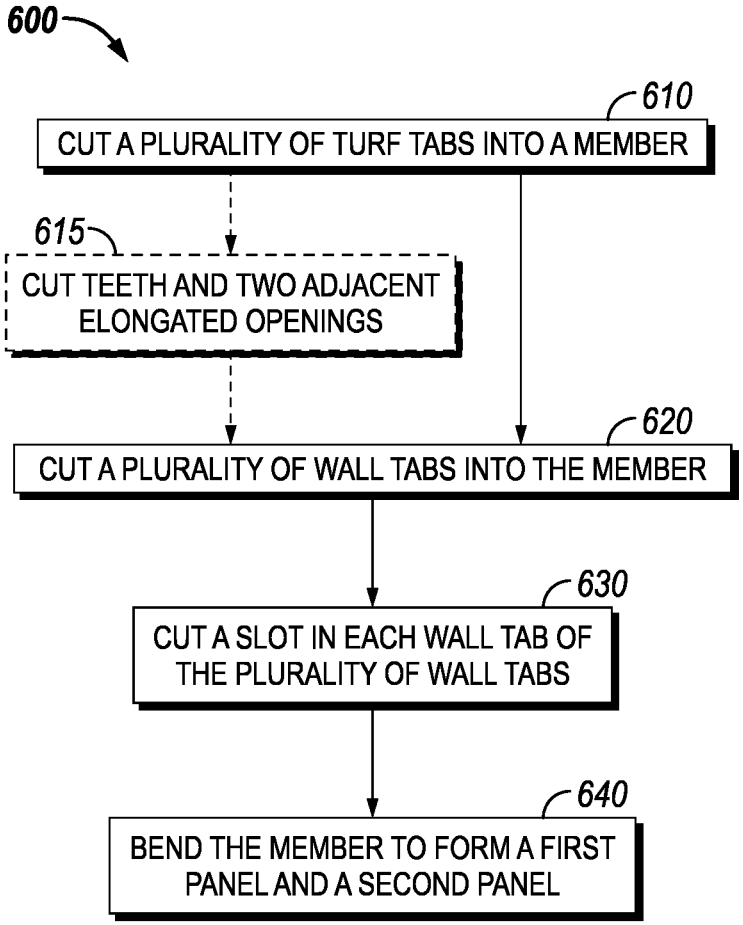
FIG. 6 is a flow chart of an embodiment of a method of the disclosure.

FIG. 6 is a flow chart of one embodiment of a method 600 of the present disclosure. The method 600 includes cutting a plurality of turf tabs into a member, at 610. The method 600 includes cutting a plurality of wall tabs into the member, at 620. The method 600 includes cutting a slot in each wall tab of the plurality of wall tabs, at 630. The method 600 includes bending the member to form a first panel and a second panel, at 640. The method 600 may include cutting teeth and two adjacent elongated openings, at 615.

As discussed above, the first panel includes a first top surface, a first bottom surface, a first edge, a second edge, a first end, and a second end. The second panel includes a second top surface, a second bottom surface, a third edge, a fourth edge, a third end, and a fourth end. The second top surface of the second panel is oriented substantially perpendicular to the first top surface of the first panel.

The second edge of the first panel is adjacent to the third edge of the second panel. The plurality of turf tabs have a first position substantially parallel to the first top surface of the first panel. The plurality of turf tabs have a second position that is at an acute angle with respect to the first top surface of the first panel. In the second position, the plurality of turf tabs extends away from the first top surface of the first panel. The turf tabs in the second position may be used to secure turf used in a playing field.

The slot of each wall tab is formed in both the first panel and the second panel. The wall tabs have an initial position and a bent position. In the initial position, a first portion of each wall tab is substantially parallel to the second panel and a second portion of each wall tab is substantially parallel to the first panel. In the bent position, the second portion of each wall tab is substantially perpendicular to the first bottom surface of the first panel extends away from the first bottom surface of the first panel. A fastener may be inserted into the slot of the wall tab to secure the member to a wall.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. An apparatus comprising:

a first panel having a first top surface, a first bottom surface, a first edge, a second edge, a first end, and a second end;

a second panel having a second top surface, a second bottom surface, a third edge, a fourth edge, a third end, and a fourth end, wherein the second top surface of the second panel is oriented substantially perpendicular to the first top surface of the first panel and the second edge of the first panel is adjacent to the third edge of the second panel; and a plurality of turf tabs along the first panel, the plurality of turf tabs being positioned between the first and second edges and between the first and second ends of the first panel, the plurality of turf tabs having a first position substantially parallel to the first top surface of the first panel and a second position that is at an acute angle with respect to the first top surface of the first panel, wherein in the second position the plurality of turf tabs extends away from the first top surface of the first panel; and a plurality of wall tabs, each wall tab of the plurality of wall tabs includes a slot.

2. The apparatus of claim 1, wherein the first and second edges having a first length and the first and second ends having a second length, the second length being less than the first length, wherein the third and fourth edges having the first length and the third and fourth ends having a third length, and wherein the third length is less than the second length.

3. The apparatus of claim 1, wherein the second edge of the first panel is connected to the third edge of the second panel.

4. The apparatus of claim 3, further comprising a bend, the bend forming the second edge of the first panel and the third edge of the second panel.

5. The apparatus of claim 1, wherein each turf tab of the plurality of turf tabs comprises a plurality of teeth.

6. The apparatus of claim 5, wherein the acute angle is between approximately 10 degrees and approximately 60 degrees.

7. The apparatus of claim 6, wherein the acute angle is between 30 degrees and 45 degrees.

8. The apparatus of claim 1, wherein the slot of each wall tab of the plurality of wall tabs is formed in both the first panel and the second panel.

9. The apparatus of claim 8, further comprising the plurality of wall tabs having an initial position and a bent position, wherein in the initial position a first portion of each wall tab of the plurality of wall tabs is substantially parallel to the second panel and a second portion of each wall tab of the plurality of wall tabs is substantially parallel to the first panel and wherein in the bent position the second portion of each wall tab is substantially perpendicular to the first bottom surface of the first panel and extends away from the first bottom surface of the first panel.

10. The apparatus of claim 5, wherein each turf tab of the plurality of turf tabs further comprises two elongated openings formed in the first panel.

11. A system comprising:

a first panel having a first top surface, a first bottom surface, a first edge, a second edge, a first end, and a second end;

a second panel having a second top surface, a second bottom surface, third edge, a fourth edge, a third end, and a fourth end, wherein the second top surface of the second panel is oriented perpendicular to the first top surface of the first panel and the second edge of the first panel is adjacent to the third edge of the second panel;

a portion of turf;

a plurality of turf tabs along the first panel, the plurality of turf tabs being positioned between the first and second edges and between the first and second ends of the first panel, the plurality of turf tabs having a first position substantially parallel to the first top surface of the first panel and a second position that is at an acute angle with respect to the first top surface of the first panel, wherein the plurality of turf tabs extend away from the first top surface of the first panel in the second position secure the portion of turf to the first panel; and a plurality of wall tabs positioned between the first and second ends of the first panel and between the third and fourth ends of the second panel, wherein each wall tab of the plurality of wall tabs includes a slot.

12. The system of claim 11, further comprising a portion of a pad layer, wherein the first panel is positioned between the portion of the pad layer and the portion of the turf.

13. The system of claim 12, further comprising a first plurality of fasteners, wherein the first plurality of fasteners secure the portion of turf to the first panel.

14. The system of claim 13, wherein the first panel and the second panel is a unitary member.

15. The system of claim 13, wherein the slot of each wall tab of the plurality of wall tabs is formed in both the first panel and the second panel.

16. The system of claim 15, further comprising a wall portion, wherein the wall portion is connected to the second panel via a second plurality of fasteners, each fastener of the second plurality of fasteners is positioned through a respective one of the slots of the plurality of wall tabs.

17. The system of claim 16, wherein each turf tab of the plurality of turf tabs comprises a plurality of teeth.

18. A method comprising:

cutting a plurality of turf tabs into a member;

cutting a plurality of wall tabs into the member;

cutting a slot in each wall tab of the plurality of wall tabs;

bending the member to form a first panel and a second panel, the first panel having a first top surface, a first bottom surface, a first edge, a second edge, a first end, and a second end, the second panel having a second top surface, a second bottom surface, third edge, a fourth edge, a third end, and a fourth end, wherein the second top surface of the second panel is oriented perpendicular to the first top surface of the first panel and the second edge of the first panel is adjacent to the third edge of the second panel;

wherein the plurality of turf tabs have a first position substantially parallel to the first top surface of the first panel and a second position that is at an acute angle with respect to the first top surface of the first panel;

wherein a first portion of each slot is in the first panel and a second portion of each slot is in the second panel; and wherein the plurality of wall tabs have an initial position and a bent position, wherein in the initial position a first portion of each wall tab of the plurality of wall tabs is substantially parallel to the second panel and a second portion of each wall tab of the plurality of wall tabs is substantially parallel to the first panel and wherein in the bent position the second portion of each wall tab is substantially perpendicular to the first bottom surface of the first panel and extends away from the first bottom surface of the first panel.

19. The method of claim 18, wherein cutting the plurality of turf tabs into the member further comprises cutting teeth and two adjacent elongated openings for each turf tab of the plurality of turf tabs.

20. The method of claim 19, wherein cutting the plurality of turf tabs into the member and wherein cutting the plurality of wall tabs and cutting the slot in each wall tab of the plurality of wall tabs further comprises using a laser cutter.

* * * * *